US006443542B1

(12) United States Patent
Lindquist et al.

(10) Patent No.: US 6,443,542 B1
(45) Date of Patent: Sep. 3, 2002

(54) CABINET SYSTEM AND METHOD OF ASSEMBLING SAME

(75) Inventors: Stephen E. Lindquist, Boylston; James F. Staples, Westford, both of MA (US); Richard E. Olson, Rindge, NH (US); Robert M. Mondor, Sutton, MA (US); Phil Tousignant, Dracut, MA (US); Kenneth D. Ganon, Westminster, MA (US)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 09/576,500

(22) Filed: May 23, 2000

(51) Int. Cl.[7] ..... A47B 87/00
(52) U.S. Cl. ..... 312/198; 312/223.1; 312/111
(58) Field of Search ..... 312/107, 111, 312/198, 199, 200, 237, 223.1, 223.2, 223.6

(56) References Cited

U.S. PATENT DOCUMENTS 4,017,331 A * 4/1977 Camenisch ..... 312/198
4,433,881 A * 2/1984 Witten et al. ..... 312/111 X
5,704,699 A * 1/1998 Pagelow et al. ..... 312/111 X
5,938,302 A * 8/1999 Anderson et al. ..... 312/198 X

* cited by examiner

*Primary Examiner*—Peter M. Cuomo
*Assistant Examiner*—Michael J. Fisher

(57) ABSTRACT

A cabinet system includes first and second cabinets each including first and second side walls, upper and lower rectilinear frames extending between the side walls at vertically spaced-apart locations therealong and weldments connecting the upper and lower frames to the side walls to form a rigid housing. A pair of spaced-apart locating holes are formed in the side wall of the first cabinet adjacent to the lower frame thereof and an additional locating hole is present in the first wall of the first cabinet adjacent to the upper frame thereof. Further, a pair of spaced-part locating pins are provided in the second side wall of the second cabinet adjacent to the lower frame thereof along with an additional locating pin in the side wall of the second cabinet adjacent to the upper frame thereof. The locating pins of the second cabinet are arranged and adapted to slide into the corresponding ones of the locating holes of the first cabinet when the second side wall of the second cabinet is positioned flush against the first side wall of the first cabinet so as to align the cabinets in the X and Y directions. Fasteners are provided for securing the second side wall of the second cabinet to the first side wall of the first cabinet. A method of aligning the two cabinets is also disclosed.

18 Claims, 2 Drawing Sheets

CABINET SYSTEM AND METHOD OF ASSEMBLING SAME

This invention relates to a cabinet system. It relates especially to cabinets adapted to house computer equipment, telecommunications apparatus and the like and to a method of assembling those cabinets to form a plural-cabinet system.

BACKGROUND OF THE INVENTION

Standard computer cabinets designed to support relatively heavy loads usually comprise individual vertical and horizontal frame members connected together to define a rectilinear frame structure or rack. Panels may be secured to the frame members to enclose the cabinet contents. To enable the cabinet to withstand the rigors of shipping and handling, the frame members usually consist of steel tubes or channels because these are inherently strong shapes. The contents of the cabinet, e.g., processors, controllers, fan units, power supplies, etc. are usually made as slide-in units or modules which must fit within the interior space defined by the frame members. Since the frame members must have a relatively large cross section, i.e., two inches or more, to give the cabinet enough strength to withstand shipping, handling and joining together, this means that the distance between the sides of the slide-in modules or units within the cabinet and the outer surface of the cabinet side wall must be in excess of two inches.

In typical computer installations, it is sometimes desirable to be able to increase the processing power of a computer by adding to the modules in one cabinet additional slide-in modules in a second similar cabinet. This is usually accomplished by positioning the second cabinet next to the first one and mechanically joining the two together taking pains to ensure that both cabinets are level and in vertical and horizontal alignment. This process usually requires at least two field technicians, particularly if the surface supporting the cabinets is not level to begin with. Then, the technicians make the necessary electrical connections between the modules in the two cabinets. Since the slide-in modules in the two cabinets are spaced apart by their respective frame members (and any side panels), the electrical connections or signal paths between the modules in the two cabinets must be at least four inches long.

While this may not have been a problem when computer processing speeds were relatively low, it has become so with today's computer systems which operate at clock speeds of 9.6 ms and lower. In other words, it is now essential to minimize the lengths of the signals paths between various modules or subassemblies of a computer system, digital switching system or the like without compromising the strength and durability of the cabinets which house those modules or subassemblies.

SUMMARY OF THE INVENTION

Accordingly, it is an object of the present invention to provide a cabinet structure for a computer, telecommunication apparatus or the like which can withstand shipping, installation and leveling loads.

Another object of the invention is to provide such a cabinet which minimizes the spacing of the cabinet contents from the exterior sides of the cabinet.

A further object of the invention is to provide a cabinet of this type which has a relatively small footprint.

Yet another object of the invention is to provide a cabinet structure which facilitates the coupling together in the field of two similar cabinets and their contents.

A further object of the invention is to provide a cabinet system composed of a plurality of cabinets coupled together side by side so as to minimize the lengths of the signals paths between the equipment in the two cabinets.

A further object of the invention is to provide a plural-cabinet system of this type which can repose in stable alignment even on an uneven support surface.

Yet another object is to provide a method of joining together two cabinets of the above type.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

In accordance with the present invention, our cabinet for computer equipment and the like is devoid of frame members at the sides of the cabinet. Rather, the side frame members are substituted for by rigid metal side plates that are connected together at various elevations on the cabinet by horizontal box frames which are welded to the side plates to form a very stiff, rigid box-like structure which is resistant to racking, bending and buckling even under a heavy load. Each stiffened cabinet side wall is quite thin so that the cabinet contents may be spaced quite close to the exterior sides of the cabinet. This allows two such cabinets to be positioned side by side so that the cabinet contents can be juxtaposed within half an inch instead of the four inches required by conventional steel frame cabinets or racks, while providing the same level of strength. Thus, our cabinet with welded-together steel side plates minimizes the lengths of the signal paths between the contents of the two cabinets. This enables a minimum capacity computer system to be shipped in one cabinet and expanded later if necessary by adding additional processing capacity in a second cabinet coupled to the first cabinet. Indeed, our cabinet design enables a single technician to join and level the cabinets in the field to form a single cabinet system even when the cabinets are supported on an uneven support surface.

For this, one side wall or plate of the first cabinet is provided with coupling means including a plurality of alignment or locating holes. Two such holes, which are round, are spaced apart horizontally and located adjacent the cabinet's lower stiffening box frame. A third alignment hole is situated adjacent the upper box frame more or less directly above one of the aforesaid lower holes. Preferably, this upper hole is vertically elongated, e.g., oval, for reasons that will become apparent. The coupling means also include a pair of threaded bolt holes located in the side wall at the lower box frame adjacent that wall's side edges. A third threaded bolt hole is present in the side wall at the upper box frame more or less midway between the side edges of that wall.

To facilitate siting the first cabinet at a particular destination, the cabinet is provided with wheels and conventional screw-type levelers so that once the cabinet is placed at the desired location in a utility or computer room, it can be leveled to compensate for an uneven floor surface.

At some point, it may become necessary or desirable to expand the computer in the first cabinet by adding additional processing capacity. In that event, a second cabinet, somewhat similar to the first one and containing additional processors, may be rolled into place beside the first cabinet and the two cabinets coupled together using coupling means on the second cabinet which cooperate with the aforesaid coupling means on the first cabinet. More particularly, the side wall of the second cabinet that faces the first cabinet is provided with a plurality of laterally projecting locating or alignment pins which are adapted to mate with the corresponding alignment holes in the side wall of the first cabinet. Thus, the side wall of the second cabinet has two horizontally spaced-apart pins adjacent the lower horizontal box frame of that cabinet. A third pin is located in the side wall opposite the upper box frame just above one of the lower pins. In other words, when the two cabinets are placed side by side, the pins extending from the side wall of the second cabinet are located substantially opposite the alignment holes in the opposing side wall of the first cabinet. As we shall see, the alignment pins are tapered and have axial symmetry. Therefore, when the two cabinets are brought together in a manner to be described, the pins on the second cabinet side wall extend into and become centered in the locating holes on the first cabinet side wall so that the two walls become aligned both vertically and horizontally. Also, three bolt holes are provided in the same side wall of the second cabinet at positions corresponding to those of the threaded bolt holes in the first cabinet.

In order to couple the second cabinet to the already sited and leveled first cabinet, the former cabinet, with its levelers raised, is rolled next to the first cabinet so that the alignment pins in the side wall of the second cabinet are positioned more or less directly opposite the corresponding alignment holes in the side wall of the first cabinet. Next, a coupling bolt is inserted through one of the lower bolt holes in the second cabinet and threaded into the corresponding hole in the first cabinet. Also, a coupling bolt is inserted through the upper bolt hole in the second cabinet and turned down into the corresponding threaded bolt hole in the first cabinet.

The aforesaid lower bolt is tightened first so that the adjacent one of the lower locating pins on the second cabinet is drawn into the corresponding locating hole in the first cabinet. Preferably, this hole is a relatively tight fitting hole so that the base of the second cabinet becomes aligned with that of the first cabinet in both the horizontal (X) and vertical (Y) directions. Then, the upper bolt is tightened so that the aforesaid pin-in-hole connections draw the corresponding cabinet side wall edges together so that they are in XY alignment. The fact that the upper locating hole in the first cabinet is vertically elongated allows the corresponding locating pin on the second cabinet to swing through an arc and still be received in that upper hole to achieve alignment of the cabinets in the event that the underlying support surface is not level such that the side walls of the two cabinets are initially not parallel. Finally, a third coupling bolt is inserted through the other lower bolt hole in the second cabinet and turned down into the corresponding threaded bolt hole in the first cabinet to complete the assembly of the two cabinets so that they abut one another and are in alignment in all three (X,Y,Z) directions.

We should emphasize at this point that the formation of the cabinets with rigid welded-together and stiffened side plates enables the stationary first cabinet to support the entire weight of the second cabinet as the latter cabinet is being joined to the first cabinet. That is, as the pin-and-hole connections are made between the two cabinets and the second cabinet is leveled and brought into alignment with the first as the coupling bolts are tightened, part or all of the second cabinet may actually be lifted off the support surface, particularly if the surface under the two cabinets is uneven. Once the joining process is completed, the levelers on the second cabinet may be lowered to the support surface so that the weight of that cabinet is borne directly by that surface.

Once joined, the slide-in modules in the two cabinets are separated by less than one-half inch. Therefore, the lengths of the signal paths connecting those modules can be kept to a minimum. Also, this construction minimizes the footprint of the joined-together cabinets thus minimizing expensive computer or utility room overhead.

BRIEF DESCRIPTION OF THE DRAWINGS

For a fuller understanding of the nature and objects of the invention, reference should be made to the following detailed description taken in connection with the accompanying drawings, In which.

DETAILED DESCRIPTION OF AN ILLUSTRATIVE EMBODIMENT

Figure 1:
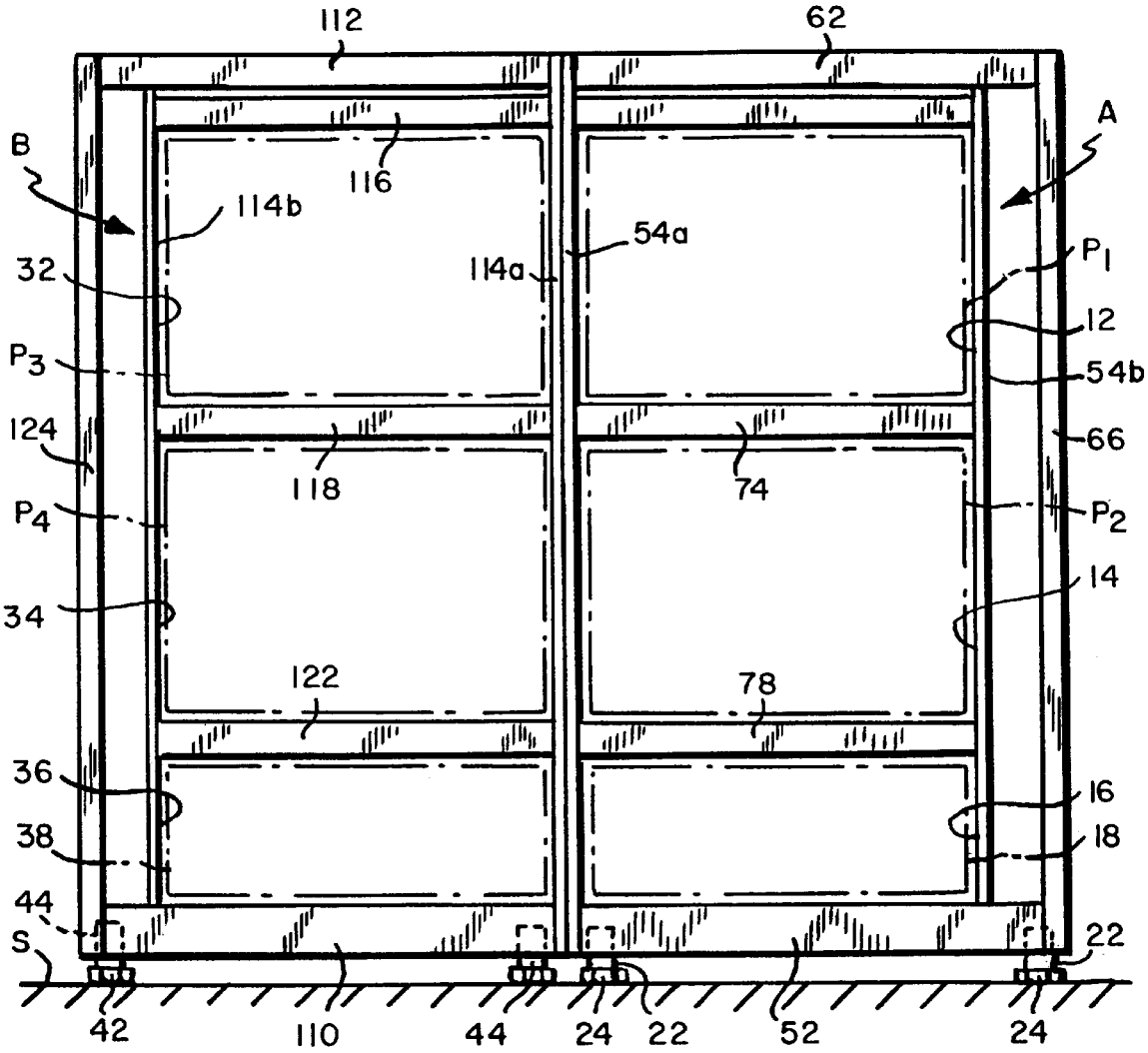
FIG. 1 is a front elevational view of a cabinet system composed of two joined-together cabinets incorporating the invention.

FIG. 1 shows a cabinet system incorporating the invention; it is composed of two side-by-side cabinets designated generally as a first cabinet A and a second cabinet B. Each cabinet defines a plurality of interior compartments for housing slide-in electronic modules or units of one kind or another. More particularly, cabinet A has an upper compartment 12, a middle compartment 14 under compartment 12 and a lower compartment 16. In the illustrated system, compartment 12 contains a computer module P1, compartment 14 contains another module P2 and the lower compartment 16 contains a slide-in fan unit 18 for cooling the contents of cabinet A. Thus, cabinet A may house a standalone computer having a certain amount of processing capability. The cabinet may be moved into a computer room or other site on wheels 22 at the underside of the cabinet and leveled by means of conventional screw-type levelers 24 extending down from the bottom of the cabinet to a support surface S.

When it becomes desirable to expand the capabilities of the computer in cabinet A, the cabinet B may be rolled into position beside cabinet A. Cabinet B is similar to cabinet A in that it has an upper compartment 32 housing a computer module P3, a middle compartment 34 containing another module P4 and a lower compartment 36 for another fan unit 38. Also, like cabinet A, cabinet B is fitted with wheels 42 and levelers 44 which can be adjusted so that the weight of cabinet B will be supported by surface S.

Once cabinets A and B are joined side-by-side as shown in FIG. 1, electrical connections (not shown) may be established between the modules in the two cabinets so that all of the modules will operate as a single computer or telecommunications system. As we shall see, the two cabinets A and B are designed and joined together so as to minimize the lengths of the signal paths between the contents of the two cabinets.

Figure 2:
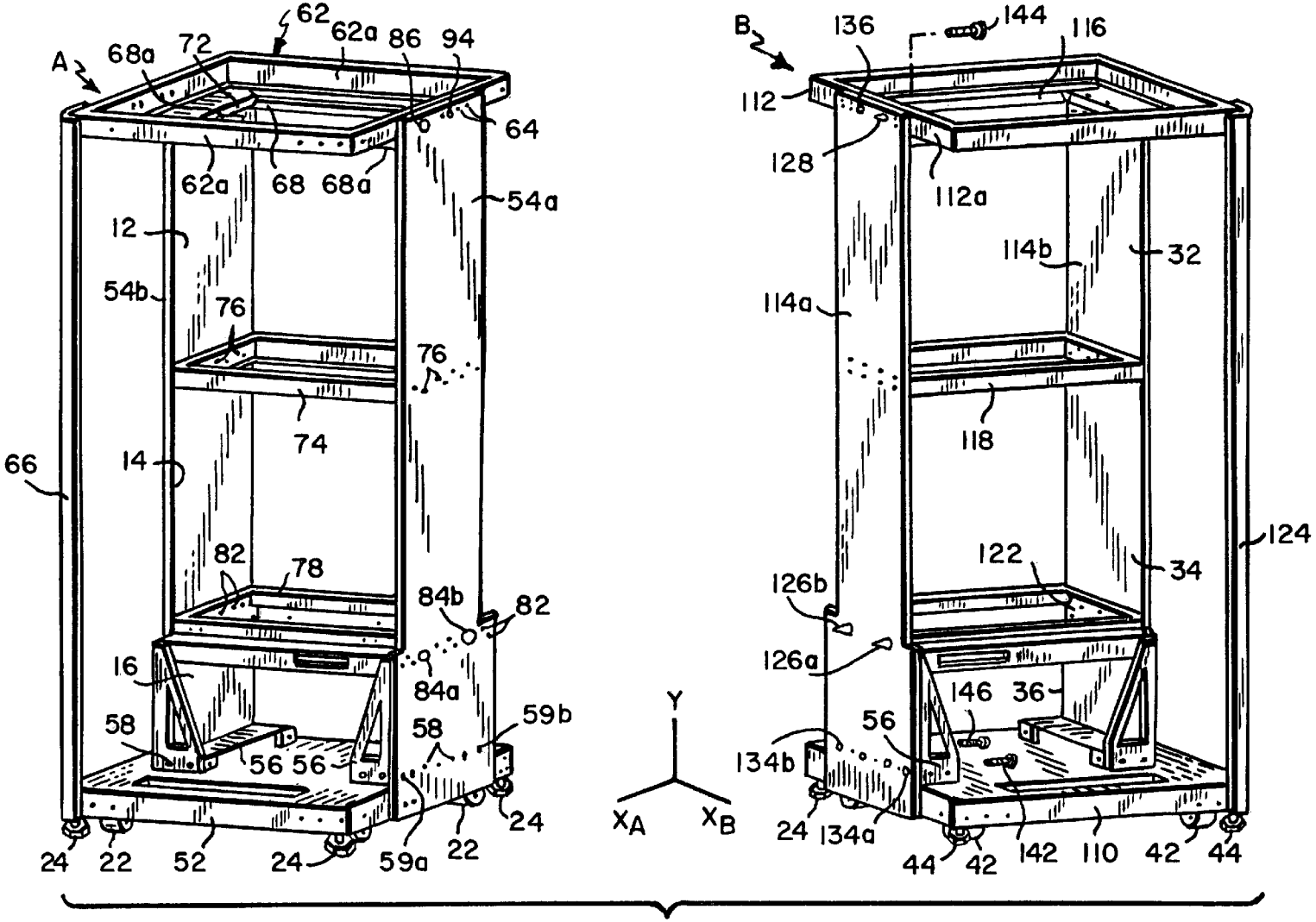
FIG. 2 is an exploded rear perspective view showing the two cabinets in FIG. 1 separated from one another.

Referring now to FIGS. 1 and 2, cabinet A comprises a generally rectangular base 52 formed as a box frame, the wheels 22 and levelers 24 being mounted near the four corners of that base. Extending up from the opposite sides of base 52 are a pair of opposite, more or less mirror image side walls 54*a* and 54*b*. These side walls, instead of being composed of tubular members or channels as in the prior art, consist of rigid but relatively thin, e.g., 0.089 inch, structural plates preferably of cold rolled steel. The lower ends of side walls 54*a* and 54*b* are secured to base 52 by means of gusset frames 56 each frame being anchored to base 52 and the corresponding wall 54*a*, 54*b* by fasteners 58 which may be rivets, threaded fasteners or the like.

As best seen in FIG. 2, the widths of walls 54*a* and 54*b* are smaller than the length of base 52 so that the base extends beyond the side edges of the two walls, the extension at the rear of the cabinet being somewhat longer than the one at the front of the cabinet.

The upper ends of the side walls 54*a* and 54*b* are connected to the opposite sides of a top frame structure 62 which has more or less the same width and length dimensions as base 52. The frame structure 62 may be formed by four channels 62*a* having a C-shaped cross section and connected together end-to-end as shown in FIG. 2. A plate (not shown) may fill the space between the channels. Side walls 54*a* and 54*b* may be secured to the top frame structure 62 by fasteners 64 similar to fasteners 58. Preferably, a vertical angle iron 66 extends between base 52 and the frame structure 62 at a rear corner of the cabinet to provide mounting surfaces for panels (not shown) to close in the rear of the cabinet.

The illustrated cabinet's unusually high resistance to bending, buckling and racking is due not only to the fact that the side walls 54*a* and 54*b* are solid steel plates, but also because these plates are stiffened along their lengths by welded box frames that are themselves welded to the interior surfaces of the plates. More particularly, cabinet A has a generally rectangular upper box frame 68 positioned between side walls 54*a* and 54*b* just under the top wall structure 62. Frame 68 is composed of four channels 68*a*. The channels are welded end-to-end to form the frame 68 which is then welded to the side s walls 54*a* and 54*b* as shown by welds 72 in FIG. 2. A similar horizontal box frame 74 partway down on side walls 54*a* and 54*b* separates compartments 12 and 14. Frame 74 is connected by welds 76 to the inner surfaces of the side walls. Finally, the cabinet includes a lower box frame 78 which separates compartments 14 and 16 and is secured to the side walls 54*a* and 54*b* by welds 82.

Thus, the portions of the cabinet side walls 54*a* and 54*b* between the upper and lower box frames 68 and 78 form a very rigid, welded-together, box-like structure whose side walls are stiffened and very resistant to bending and buckling. This enables the distance between the modules P1 and P2 in cabinet A and the outside surface of the cabinet to be quite small, i.e., under a quarter inch.

As best seen in FIG. 2, a pair of similar, round locating or alignment holes 84*a* and 84*b* are provided in side wall 54*a* opposite the lower box frame 78. These two holes which also extend through the adjacent box frame member, are spaced apart horizontally so that they are relatively close to the front and rear edges of that wall. Preferably hole 84*b* is slightly larger than hole 84*a*. A third locating or alignment hole 86 is present in side wall 54*a* and the adjacent channel 62*a* more or less directly above hole 84*a*. Preferably, locating hole 86 is vertically elongated, i.e., an oval.

Threaded bolt holes 59*a* and 59*b* are present at locations adjacent to the two lower corners of wall 54*a* opposite gusset frame 56. The threads for holes 59*a* and 59*b* may be provided by threaded inserts mounted in frame 56 behind wall 54*a*.

Also present in side wall 54*a* adjacent channel 62*a* midway between the side edges of that wall is a third threaded bolt hole 94 that will be used to join cabinets A and B in a manner to be described. The threaded bolt hole 94 may be formed by a threaded insert mounted to the channel 62*a* behind wall 54*a*.

Referring now to FIGS. 1 and 2, the second cabinet B is more or less a mirror image of cabinet A in that it has a base 110, top wall structure 112 composed of channels 112*a* and opposite side walls 114*a* and 114*b* stiffened by upper, middle and lower welded box frames 116, 118 and 122, respectively, welded to the side plates at the same elevations as the box frames in cabinet A. There is also a vertical angle iron 124 similar to angle iron 66 at the right rear corner of cabinet B.

Cabinet B differs from cabinet A in that it has a pair of locating or alignment pins 126*a* and 126*b* projecting from side wall 114*a* at lower box frame 122. Pins 126*a* and 126*b* are shaped and arranged to project into the alignment holes 84*a* and 84*b* in cabinet A when the two cabinets are positioned together side by side as shown in FIG. 1.

Also, a third alignment pin 128 projects from the upper end of side wall 114*a*, that pin being shaped and arranged to project into the upper alignment hole 86 of cabinet A when the two cabinets are located as in FIG. 1. Preferably, all of the alignment pins have 10 threaded shanks which extend through holes in the side wall 114*a* (and through the adjacent box frame members), all of the pins being anchored in place by suitable nuts (not shown).

As shown in FIG. 2, a pair of bolt holes 134*a* and 134*b* are provided adjacent to the lower corners of side wall 114*a* at the gusset frame 56. These bolt holes extend not is only through the side wall, but also through the gusset frame 56 which attaches the side wall to base 110. A third bolt hole 136 is provided in the side wall 114*a* opposite channel 112*a* next to locating pin 128. When the two cabinets A and B are situated side by side as in FIG. 1, the bolt holes 134*a* 134*b* and 136 are arranged and adapted to register with the corresponding bolt holes 59*a*, 59*b* and 94, respectively, in cabinet A.

In all other respects, cabinet B is similar to cabinet A so that side walls 114*a*, 114*b* and horizontal frames 116, 118 and 122 form a very rigid box-like structure which is resistant to bending and buckling and which, therefore, can withstand rough handling. Yet, as with cabinet A, the modules P3 and P4 in cabinet B can be located very close to the exterior surface of side wall 114*a*.

After cabinet A is moved into position on surface S and leveled using levelers 44, a single technician can couple the second cabinet B to cabinet A with a minimum of effort even if the support surface S is uneven. More particularly, when it is time to add the computer modules in cabinet B to those in cabinet A, cabinet B, with its levelers 44 in the raised position, may be rolled along surface S on wheels 42 until the side wall 114*a* of cabinet B is located directly opposite the side wall 54*a* of cabinet A with the two walls being spaced about one inch apart. Then, the technician may insert a coupling bolt 142 through bolt hole 134*a* in cabinet B and begins threading the bolt into hole 59*a* in cabinet A. Next, the technician inserts a bolt 144 through the upper bolt hole 136 in cabinet B and begins threading that bolt into the upper threaded hole 94 in cabinet A. If the support surface S is uneven, cabinet B may initially be tilted somewhat with respect to cabinet A. The technician now tightens bolt 142 first to first set the alignment of the base 110 of cabinet B. In other words, as bolt 142 is tightened, the seating of pin 126*a* on cabinet B in the close fitting locating hole 84*a* in cabinet A shifts the base of cabinet B along the horizontal ($X_B$) and vertical (Y) axes as necessary to align the bases of the two cabinets. Pin 126*b* on cabinet B also penetrates the locating hole 84*b* in cabinet A. Since this hole is larger than hole 84*a*, i.e. loose fitting, the pin will enter hole 84*b* even if the two cabinets are somewhat out of alignment. Next, the technician tightens the upper bolt 144 thereby drawing the front and rear edges of the cabinet walls 54*a* and 114*a* into XY alignment. As noted above, since the upper locating hole 86 in cabinet A is vertically elongated, it allows pin 128 on cabinet B to swing through an arc as the cabinets come together in the event that surface S is not level and the cabinet walls 54*a* and 114*a* are not parallel. Lastly, the technician inserts a bolt 146 through the other lower hole 134*b* in cabinet B and turns that bolt down into the corresponding threaded hole 59*b* in cabinet A to complete the assembly.

The movement of cabinet B toward cabinet A as the pin-in-hole connections are made during the joining process may require that some or all of the weight of cabinet B and its contents be borne by cabinet A. This load will manifest itself at the pin-in-hole and bolt connections between the two cabinets. As described above, these connections are located at the upper and lower boundaries of the stiffened box structure defined by the aforesaid welded-together side plates and box frames. Therefore, cabinet A is well able to support the full weight of cabinet B and its contents without bending or buckling; the same is true for cabinet B.

Once the bolts are is tightened, the two cabinets are held in close alignment. At this point, the technician may lower the levelers 44 on the base 110 of cabinet B to the underlying support surface S as shown in FIG. 1 so that the weight of cabinet B is borne directly by surface S rather that by the connections between the two cabinets. The necessary electrical connections can now be made between the modules in the two cabinets. These connections can be of minimal length because the side walls 54*a* and 114*a* of the two cabinets are essentially flush together so that the modules in the two cabinets are separated only by the combined thickness of those two walls. In this connection, we should mention that the corresponding fasteners 58, 64 on cabinet A are offset from the corresponding fasteners on cabinet B and dimples or recesses (not shown) are provided in the outer surfaces of each side wall 54*a* and 114*a* to provide clearance for the exterior fastener heads on the opposing side wall, thus allowing the two walls to butt together. In practice, then, the lengths of those signal paths can be less than one-half inch. For the same reason, the two-cabinet system illustrated in FIG. 1 has a minimum size footprint, thereby minimizing the floor space occupied by the system.

It will thus be seen that the objects set forth above, among those made apparent from the preceding description, are efficiently attained. Also, certain changes may be made in the above description with departing from the scope of the invention. For example, the alignment pins 126*a*, 126*b* and 128 may have some other shape that will achieve Y/X alignment, e.g., a parabolic or hyperbolic shape, a four-sided pyramid, etc. Therefore, it is intended that all matter contained in the above description or shown in the accompanying drawings shall be interpreted as illustrative and not in a limiting sense. It is also to be understood that the following claims are intended to cover all of the generic and specific features of the invention described herein.

What is claimed is:

1. A cabinet system comprising pair of spaced-apart, upstanding, parallel, elongated side walls, each side wall consisting of a rigid plate having upper and lower edges;

upper and lower rectilinear box frames extending between said side walls at vertically spaced locations therealong;

upper and lower weldments connecting said upper and lower frames to said side walls to form a rigid, welded-together, box-like housing defining at least one interior compartment for contents that may be spaced from the housing exterior solely by the thickness of each plate;

a pair of spaced-apart locating pins connected directly to the lower frame and projecting laterally from one of said side walls;

a third locating pin connected directly to the upper frame and projecting laterally from said one of said side walls, and a bolt hole extending through said one of said side walls adjacent to said upper frame.

2. The cabinet system defined in claim 1 and further including a third rectilinear frame extending between said side walls between said upper and lower frames, and a third weldment connecting said third frame to said side walls to define upper and lower interior compartments between said side walls.

3. The cabinet system defined in claim 1 and further including a base connecting the lower edges of said plates.

4. The cabinet system defined in claim 3 and further including a plurality of spaced-apart wheels extending down from said base, and a plurality of spaced-apart, vertically adjustable levelers extending down from said base.

5. The cabinet system defined in claim 3 and further including a top wall structure connecting the upper edges of said plate above said frames.

6. A cabinet system comprising first and second cabinets each including first and second side walls, upper and lower rectilinear frames extending between the side walls at vertically spaced locations therealong and weldments connecting the upper and lower frames to said side walls to form a rigid housing;

a pair of spaced-apart first locating means extending laterally from the first side wall of said first cabinet adjacent to the lower frame thereof;

an additional first locating means in the first wall of said first cabinet adjacent to the upper frame thereof;

a pair of spaced-part second locating means in the second side wall of the second cabinet adjacent to the lower frame thereof;

an additional second locating means in said second side wall of the second cabinet adjacent to the upper frame thereof, said first locating means being arranged and adapted to slidably interfit with the corresponding ones of said second locating means when said second side wall of the second cabinet is positioned flush against the first side wall of the first cabinet, and fastener means for securing the second side wall of the second cabinet to the first side wall of the first cabinet.

7. The cabinet system defined in claim 6 wherein said first locating means comprise holes and said second locating means comprise tapered locating pins.

8. The cabinet system defined in claim 7 wherein said additional first locating means is a vertically elongated hole.

9. The cabinet system defined in claim 7 wherein the pair of first locating means comprise different size holes.

10. The cabinet system defined in claim 6 wherein each cabinet also includes a generally horizontal base extending between the first and second side walls of that cabinet below the lower frame thereof;

a plurality of spaced-apart wheels extending down from said base, and a plurality of spaced-apart, vertically adjustable levelers extending down from said base.

11. The cabinet system defined in claim 10 wherein each cabinet also includes a third rectilinear frame extending between the first and second side walls between said upper and lower frames, and additional weldments connecting said third frame to said first and second side walls to define upper and lower interior compartments between said first and second side walls of each cabinet.

12. The cabinet system defined in claim 6 wherein said fastener means comprise a bolt extending through the second side wall of the second cabinet and the first side wall of the first cabinet adjacent to the upper frames of said cabinets, and means for holding the bolt in place.

13. The cabinet system defined in claim 12 wherein the holding means comprise a threaded hole that receives the bolt.

14. The cabinet system defined in claim 13 and further including a first a pair of bolt holes in the first side wall of the first cabinet adjacent to lower frame thereof;

a second pair of bolt holes in the second side wall of the second cabinet adjacent to the lower frame, thereof, said second pair of bolt holes being in alignment with the first pair of bolt holes when said first locating means interfit with said second locating means, and fasteners extending through said bolt holes for securing said cabinets together.

15. A method of assembling a cabinet system composed of first and second cabinets each cabinet including first and second side walls, upper and lower rectilinear frames extending between the side walls at vertically spaced locations therealong and weldments connecting the upper and lower frames to the side walls to form a rigid housing, said method comprising the steps of forming a pair of spaced-apart locating holes in the first side wall of the first cabinet adjacent to the lower frame thereof;

forming a third locating hole in the first wall of the first cabinet adjacent to the upper frame thereof;

providing a pair of spaced-apart laterally extending locating pins in the second side wall of the second cabinet adjacent to the lower frame thereof;

providing a third laterally extending locating pin in the second side wall of the second cabinet adjacent to the upper frame thereof, the locating holes of the first cabinet being positioned correspondingly to the locating pins of the second cabinet;

locating and leveling the first cabinet on a support surface;

moving the second cabinet to a position on the support surface next to the first cabinet so that the second side wall of the second cabinet is opposite the first side wall of the first cabinet and close enough to said first wall that the pair of locating pins of the second cabinet extend partially into the pair of locating holes of the first cabinet;

using a first threaded fastener extending through opposing walls of the two cabinets at a location adjacent to the cabinet lower frames and one of the pair of locating pins and locating holes, drawing the two cabinets together so that one of the pair of locating pins seats in the corresponding one of the pair of locating holes thereby aligning the lower ends of the two cabinets in the X and Y directions;

using a second threaded fastener extending through opposing walls of the two cabinets at a location adjacent to the cabinet upper frames and the third locating pin and locating hole, drawing the upper ends of the two cabinets together so that the upper ends of the cabinets are brought into alignment in the X and Y directions, and using a third threaded fastener extending through the opposing walls of the two cabinets at a location adjacent to the cabinet lower frames and the other of the pair of locating pins and locating holes, drawing the two cabinets together so that said other of the pair of locating pins seats in the corresponding other of the pair locating holes thereof completing the joinder of the two cabinets in side-by-side alignment.

16. The method defined in claim 15 including additional step of positioning levelers between the second cabinet and the support surface so that the entire weight of the second cabinet is borne by the support surface.

17. The method defined in claim 15 including the step of forming the third locating hole with vertical elongation.

18. The method defined in claim 15 including the step of dimensioning the pair of locating holes so that said one of the pair of locating holes provides a tight fit for the corresponding one of the pair of locating pins and the other of the pair of locating holes provides a looser fit for the corresponding other of the pair of locating pins.

* * * * *